United States Patent [19]

Blaskowski

[11] 4,241,670

[45] Dec. 30, 1980

[54] COAL FEED SYSTEM FOR A FLUIDIZED BED BOILER

[75] Inventor: Henry J. Blaskowski, West Simsbury, Conn.

[73] Assignee: Combustion Engineering, Inc., Windsor, Conn.

[21] Appl. No.: 21,396

[22] Filed: Mar. 19, 1979

Related U.S. Application Data

[62] Division of Ser. No. 884,651, Mar. 8, 1978, Pat. No. 4,176,623.

[51] Int. Cl.[3] ..... F23K 3/02

[52] U.S. Cl. ..... 110/104 R; 110/245; 110/263; 110/347; 122/4 D

[58] Field of Search ..... 110/245, 263, 264, 265, 110/347, 104 R, 105.6, 115, 267, 327, 106, 260, 261; 431/7, 170; 34/57 A; 122/4 D

[56] References Cited

U.S. PATENT DOCUMENTS

| | | | |
|---|---|---|---|
| 751,350 | 2/1904 | Schutz | 110/347 |
| 2,302,485 | 11/1942 | Whitsitt | 110/105.6 |
| 2,885,199 | 5/1959 | Patterson | 110/327 X |
| 3,772,999 | 11/1973 | Miller et al. | 110/245 |

*Primary Examiner*—Edward G. Favors
*Attorney, Agent, or Firm*—William W. Habelt

[57] ABSTRACT

An individual cell of a fluidized bed includes a static bed disposed immediately below the fluidization region with a coal feed system, which incorporates means for igniting the coal, embedded within the static bed. Coal is fed to the static bed through a coal pipe which extends vertically upward through the bed support plate into said bed and which terminates therein in a coal distributor having a series of openings around its circumference. The coal is swirled as it flows upward through the coal pipe with resultant centrifugal force imparted to the coal ensuring that the coal will be propelled out of the openings in the distributor head and evenly distributed over the cell area.

2 Claims, 2 Drawing Figures

COAL FEED SYSTEM FOR A FLUIDIZED BED BOILER

CROSS REFERENCE TO RELATED APPLICATION

This application is a division of application Ser. No. 884,651, filed Mar. 8, 1978, now U.S. Pat. No. 4,176,623.

BACKGROUND OF THE INVENTION

This invention relates to fluidized bed combustion and more particularly to a coal injection system for evenly distributing the coal over the cell area.

The need to burn coal as a principal energy source has provided an impetus for examining various methods of burning fuel in an environmentally acceptable manner. Among the methods in which interest has been rekindled is that of burning the coal in a fluidized bed. In a fluidized-bed arrangement, coal and air are reacted in a bed of particulate matter that is agitated by the flow of the air to the extent that it attains a quasi-liquid state. The advantages of this mode of burning coal lie in the ability of the fluidized bed to burn the coal in a comparatively small volume, to conduct heat relatively rapidly to heating surfaces placed in the fluidized bed, and to absorb the sulfur in the coal if the fluidized medium includes material that reacts with the oxidized sulfur.

One type of fluidized bed combustor cell comprises a combustion region with a static bed disposed immediately below the fluidization region. Coal is fed into the static bed and air is blown upward through the bed into the fluidization region in such a manner as to fluidize the coal particles but not the particles making up the static bed.

A typical method of feeding the coal into the bed is through a feed pipe projecting vertically upward into the bed. The coal is distributed throughout the area of the cell by gravity as it overflows from the feed pipe. A major problem associated with such a feed system is that a large number of feed pipes must be used in order to lower the cell area per feed point to ensure that the coal is evenly distributed. Additionally, provision must be made to ensure uniform ignition across the bed which necessarily becomes more difficult as the number of feed points increases.

SUMMARY OF THE INVENTION

The present invention is therefore an apparatus for facilitating the operation of a fluidized bed combustion cell by ensuring an even distribution of coal over the cell area.

In accordance with the invention, a coal pipe extends vertically upward through the bed support into the fluidized bed combustion cell and terminates therein in a coal distributor having a series of openings around its circumference. A vertical gas pipe extends upward interior to and concentric with the coal pipe and communicates with at least one open-ended horizontal gas pipe disposed within the coal distributor. The horizontal gas pipe is aligned such that its end openings are in registration with a pair of circumferential openings in the coal distributor so as to allow ignitor fuel to flow up the vertical pipe and out the ends of the horizontal pipe thru the circumferential openings in the coal distributor into the static bed.

A helical swirl plate is disposed interior to the fuel pipe and coiled around the vertical gas pipe. The helical swirl plate causes coal being fed to the bed through the coal pipe to follow a helical path thereby causing a swirl to be imparted to the coal. The coal entering the distributor is propelled out of the distributor into the bed through the openings around the circumference of the distributor by the centrifugal force associated with the swirl imparted to the coal as it flows through the coal pipe.

BRIEF DESCRIPTION OF THE DRAWINGS

These and further features and advantages of the present invention will be described with reference to the attaching drawings, in which.

DETAILED DESCRIPTION OF THE PREFERRED EMBODIMENT

Figure 1:
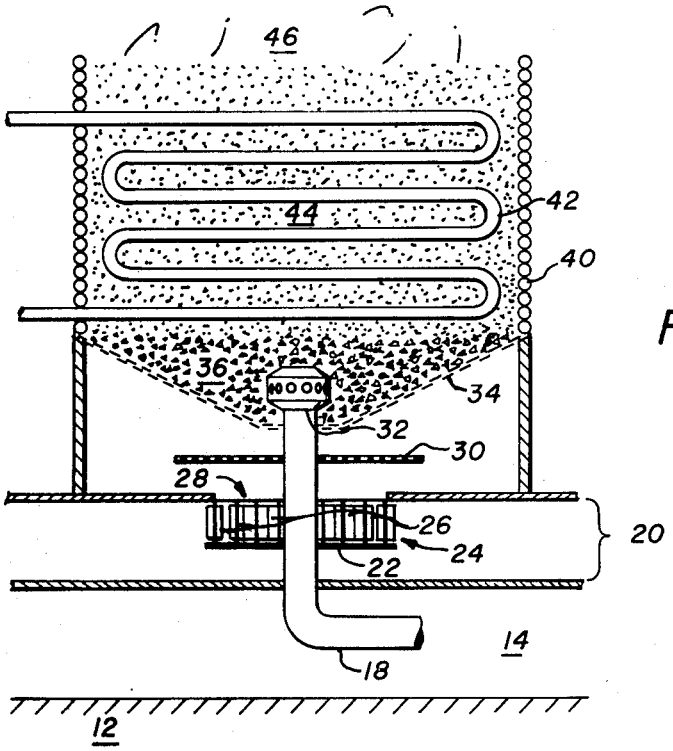
FIG. 1 is a partly sectional vertical elevation of a cell in a fluidized-bed boiler constructed according to the teachings of the present invention.

FIG. 1 shows a single cell of a fluidized-bed boiler. It is thought beneficial to divide a fluidized-bed boiler into several segments, or cells, for efficient operation and control. Since some designers prefer that bed-level heat-transfer surfaces be provided as water-cooled walls as well as tubes embedded in the fluidizing region, the segmented arrangement has the further advantage that it increases wall, and therefore heat-transfer, area. Thus, though the arrangement in FIG. 1 could in principle be the entire combustion area of a boiler, it would be more typical for it to be a single cell in a multi-cell boiler.

The combustion region is bounded on the sides by horizontal waterwalls 40 and on the bottom by the upper surface of an air duct, or windbox 20. The windbox is a horizontal duct that is positioned parallel to the floor 12 of the structure, the space between the windbox 20 and the floor 12 defining an access space 14. A static-bed support 34 is positioned above the windbox 20 and extends across the entire area of the cell. It is somewhat dish-shaped, being deeper in the center than on the sides, and it contains inert heat-storage particles, such as heavy ores, in a static-bed region 36. The static-bed support 34 has appropriate openings for allowing air, but not heat-storage particles, to pass through it.

Above and immediately adjacent to the static bed is a fluidizing region 44, which is shown in the drawing as being occupied by a fluidized mass of particles. This suggests the normal operation of the bed, in which the fluidization creates a quasi-liquid mass having a more or less definite upper boundary above which the so-called freeboard region 46 extends. The freeboard region, whose purpose is to provide a region in which particles thrown from the bed can execute a complete trajectory and fall back into the bed without being drawn out with the exhaust gases, is not shown surrounded by a waterwall. This is because the cell shown in FIG. 1 is merely one segment of a larger boiler, and it may be permissible for particles thrown from the bed to be returned to an adjacent bed. Of course the waterwalls could be extended up to enclose the freeboard region.

As seen in FIG. 1, a coal pipe 18 is led horizontally along the access space 14 and bent upward to proceed vertically, penetrating the windbox 20 and extending up through bed support plate 34 into the static bed 36, terminating in a coal distributor 32 that houses an ignitor and is located in the static bed. The upper surface of the windbox 20 has a circular opening 28 concentric with the coal pipe 18. A damper 24, whose purpose is to regulate the flow of air from the interior of windbox 20 through the opening 28, is positioned in opening 28. The damper 24 has a lower plate 22 that prevents air from entering the damper 24 from the bottom. The damper also includes blades 26 that are adjustable for controlling the amount of air admitted to the damper 24 and through the opening 28. Between the opening 28 and the static bed support 34 is provided a baffle plate 30, which is also concentric with the pipe 18. Since the function of the baffle plate 30 is to distribute properly the air entering through the opening 28, it is appropriately shaped or perforated for this purpose.

Figure 2:
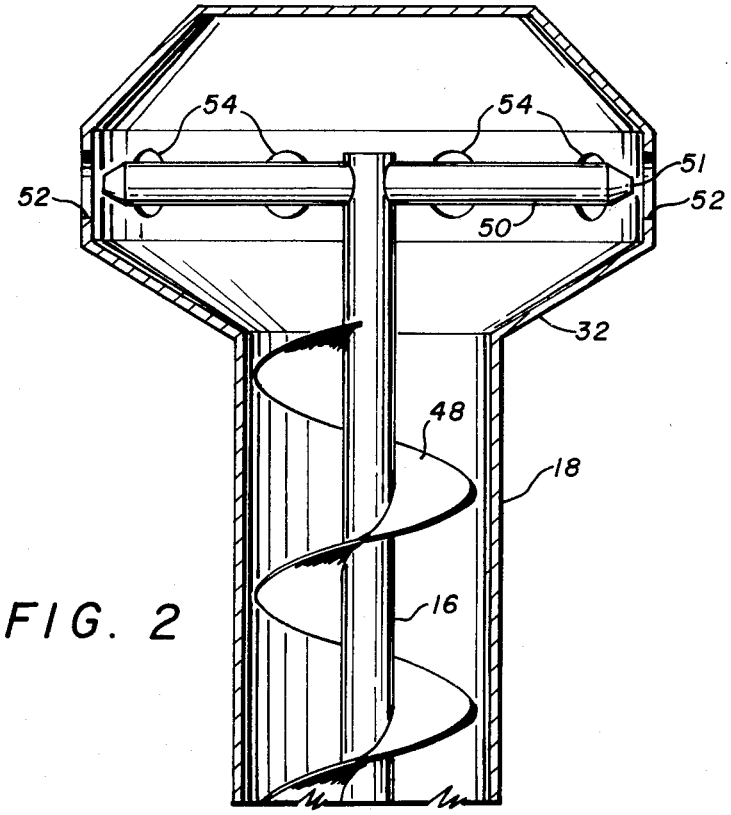
FIG. 2 is a more detailed vertical section of the coal distributor and part of the coal pipe shown in FIG. 1.

The coal pipe 18 and coal distributor 32 are shown in more detail in FIG. 2. A section of the coal pipe 18 and the distributor 32 and a vertical elevation of the gas pipes 16 and 50 and the helical swirl plate 48 are displayed. The first gas pipe 16 is positioned interior to and concentric with the coal pipe 18, and a helical swirl plate 48 is coiled around it. A second gas pipe 50 is positioned horizontally in the interior of the coal distributor 32, and it communicates with the vertical gas pipe 16 to allow gas to flow from the vertical pipe 16 to the horizontal pipe 50. Though only one horizontal pipe 50 is shown in the drawing, it would be typical for a second horizontal pipe, also in communication with the vertical pipe 16, to be provided at right angles with the horizontal pipe shown. The second horizontal pipe would also have holes in both ends similar to the openings 51 that occupy either end of the horizontal gas pipe 50. The openings 51 are positioned in registration with coal-distribution holes 52, which, along with other holes 54, are spaced around the circumference of coal distributor 32.

Though pipes 16 and 50 have been referred to as gas pipes, any other suitable ignitor fuel could be supplied through these pipes. Ignitor fuel entering through these pipes is sprayed out of coal distributor 32 through the holes 52 that register with the openings 51 and the horizontal gas pipe 50. This ignitor fuel is lighted by any appropriate means to create a flame whose purpose is to ignite coal supplied through the coal pipe 18. As an inspection of the apparatus will reveal, a coal-air mixture entering through the coal pipe 18 will be caused to follow a helical path by the helical swirl plate 48, and centrifugal force will cause the coal to be propelled out of the distributor through holes 52 and 54.

Operation of the fluidized bed is initiated by feeding ignitor fuel through gas pipes 16 and 50. The ignitor fuel is lighted at the openings 51 by appropriate means not shown in the drawings, and the resulting combustion begins to heat the particles in the static bed 36. To a lesser extent, the heat-transfer surfaces 40 and 42 and the particles in the remainder of the combustion area are also heated. After the static bed has reached a temperature that is high enough to support ignition of the coal, coal feed is initiated through the coal pipe 18, which conducts it to the interior of the coal distributor 32. Centrifugal force resulting from the helical path that the coal is forced to take propels it out of openings 52 and 54, sending it through the space between the particles in the static bed 36 and distributing it evenly over the cell area. As the coal leaves the coal distributor 32, it is ignited by the gas flame or by heat from coal already burning in the static inert-particle bed 36. Much of the fuel is blown into the fluidized-bed region 44, but this fuel is not fluidized at first, because the air-flow rate is initially relatively low.

The coal feed is gradually increased to full capacity, and since the combustion is self-sustaining, the flow of auxiliary fuel is discontinued. This mode is maintained until the bed temperature reaches, say, 1500° F. When this temperature is reached, steady-state operation is begun by opening the damper 24 far enough to permit a fluidizing flow of air and turning down the coal feed to the desired rate.

What is claimed is:

1. An apparatus for feeding coal into a fluidized bed combustion cell having a bed support plate, comprising:

a. coal pipe extending vertically upward through the bed support plate;

b. vertically orientated, generally cylindrical coal distributor mounted upon said coal pipe and opening thereto for receiving coal therefrom, said coal distributor having a plurality of openings spaced around its circumference;

c. means operatively associated with said coal pipe for imparting a swirl to the coal before the coal enters said coal distributor;

d. means for supplying ignitor fuel to the fluidizer bed combustion cell comprising a first gas pipe positioned interior to and concentric with said coal pipe and extending into said coal distributor;

e. a second gas pipe having openings in both ends disposed in said coal distributor in communication with and at right angles with said first gas pipe, each of said end openings being in registration with one of said plurality of openings spaced around the circumference of said coal distributor; and f. means operatively associated with said ignitor fuel supply means for igniting said ignitor fuel so as to create a flame for igniting the coal supplied through said coal pipe.

2. An apparatus as recited in claim 1 wherein said means for imparting a swirl to the coal before the coal enters said coal distributor comprises a helical swirl plate coiled around said first gas pipe so as to cause the coal passing through said coal pipe to follow a helical path.

* * * * *